US011619909B2

(12) United States Patent
Winkler et al.

(10) Patent No.: US 11,619,909 B2
(45) Date of Patent: Apr. 4, 2023

(54) ROTATING RESONATOR WITH FLEXURE BEARING MAINTAINED BY A DETACHED LEVER ESCAPEMENT

(71) Applicant: ETA SA Manufacture Horlogere Suisse, Grenchen (CH)

(72) Inventors: Pascal Winkler, St-Blaise (CH); Jean-Luc Helfer, Le Landeron (CH); Gianni Di Domenico, Neuchatel (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 975 days.

(21) Appl. No.: 16/344,567

(22) PCT Filed: Jul. 27, 2017

(86) PCT No.: PCT/EP2017/069041
§ 371 (c)(1),
(2) Date: Apr. 24, 2019

(87) PCT Pub. No.: WO2018/095595
PCT Pub. Date: May 31, 2018

(65) Prior Publication Data

US 2019/0302695 A1 Oct. 3, 2019

(30) Foreign Application Priority Data

Nov. 23, 2016 (EP) ..... 16200152

(51) Int. Cl.
*G04B 15/08* (2006.01)
*G04B 17/28* (2006.01)
(Continued)

(52) U.S. Cl.
CPC ..... *G04B 15/08* (2013.01); *G04B 15/14* (2013.01); *G04B 17/28* (2013.01); *G04B 18/02* (2013.01); *G04B 17/045* (2013.01); *G04B 17/26* (2013.01)

(58) Field of Classification Search
CPC ..... G04B 15/08; G04B 15/14; G04B 17/28; G04B 18/02; G04B 17/045; G04B 17/26
See application file for complete search history.

(56) References Cited

U.S. PATENT DOCUMENTS 3,501,910 A 3/1970 Clifford
8,500,323 B2 * 8/2013 Zaugg ..... G04B 13/022 368/132
(Continued)

FOREIGN PATENT DOCUMENTS

CH 469 299 A 11/1968
CN 102375401 A 3/2012
(Continued)

OTHER PUBLICATIONS

Japanese Office Action dated Feb. 2, 2021 in Japanese Patent Application No. 2019-526552 (with English translation), 3 pages.
(Continued)

*Primary Examiner* — Sean Kayes
(74) *Attorney, Agent, or Firm* — Oblon, McClelland, Maier & Neustadt, L.L.P.

(57) ABSTRACT

Timepiece regulator (300) comprising a detached lever (7) escapement mechanism (200), and a resonator (100) including an inertia element (2), which includes an impulse pin (6) cooperating with a fork (8) of the lever (7), and which is subjected to the action of elastic return means (3) fixed to the plate (1) and is arranged to cooperate indirectly with an escape wheel set (4), this resonator (100) is a resonator with a virtual pivot rotating about a main direction (DP), with a flexure bearing returned by flexible strips (5) attached to the
(Continued)

plate (1), defining a virtual pivot having a main axis (DP), the resonator (100) is attached to an elastic suspension strip (9) attached to the plate (1), allowing displacement in the main direction (DP), the plate (1) comprising shock absorber stops (11, 12), in the main direction (DP), cooperating with at least one stiff element of the inertial element (2).

22 Claims, 6 Drawing Sheets

(51) Int. Cl.

| | |
|---|---|
| ***G04B 15/14*** | (2006.01) |
| ***G04B 18/02*** | (2006.01) |
| *G04B 17/04* | (2006.01) |
| *G04B 17/26* | (2006.01) |

(56) References Cited

U.S. PATENT DOCUMENTS

| | | | | |
|---|---|---|---|---|
| 9,201,398 | B2 * | 12/2015 | Cusin | G04B 17/02 |
| 9,465,362 | B2 * | 10/2016 | Cusin | G04B 17/045 |
| 2013/0176829 | A1 | 7/2013 | Cusin et al. | |
| 2015/0063082 | A1 * | 3/2015 | Stranczl | G04B 15/06 368/127 |
| 2015/0063084 | A1 * | 3/2015 | Kawauchiya | G04B 15/10 368/130 |
| 2015/0248112 | A1 * | 9/2015 | Stranczl | G04B 15/10 368/132 |
| 2016/0179058 | A1 * | 6/2016 | Born | G04B 17/04 368/167 |
| 2016/0246257 | A1 * | 8/2016 | Cusin | G04B 43/002 |
| 2017/0269551 | A1 | 9/2017 | Semon et al. | |
| 2017/0322517 | A1 * | 11/2017 | Semon | G04B 17/10 |

FOREIGN PATENT DOCUMENTS

| | | | |
|---|---|---|---|
| CN | 103097965 | A | 5/2013 |
| CN | 105717777 | A | 6/2016 |
| CN | 105980938 | A | 9/2016 |
| EP | 2 894 520 | A2 | 7/2015 |
| EP | 2 990 885 | A1 | 3/2016 |
| EP | 3 032 352 | A1 | 6/2016 |
| JP | 02-273323 | A | 11/1990 |
| JP | 2011-185932 | A | 9/2011 |
| JP | 2013-531257 | A | 8/2013 |
| JP | 2017-51 4152 | A | 6/2017 |
| JP | 2017-534892 | A | 11/2017 |
| JP | 2019-536038 | A | 12/2019 |
| JP | 2019-537015 | A | 12/2019 |
| JP | 2020-501167 | A | 1/2020 |
| WO | WO 2015/097066 | A2 | 7/2015 |

OTHER PUBLICATIONS

International Search Report dated May 4, 2018 in PCT/EP2017/069041 filed on Jul. 27, 2017.

Japanese Office Action dated Jul. 7, 2020 in Japanese Application 2019-526552 (with English Translation), 4 pages.

Chinese Office Action dated Jun. 15, 2020 in Chinese Application 201780072304.0 (with English Translation), 8 pages.

* cited by examiner

Fig. 12
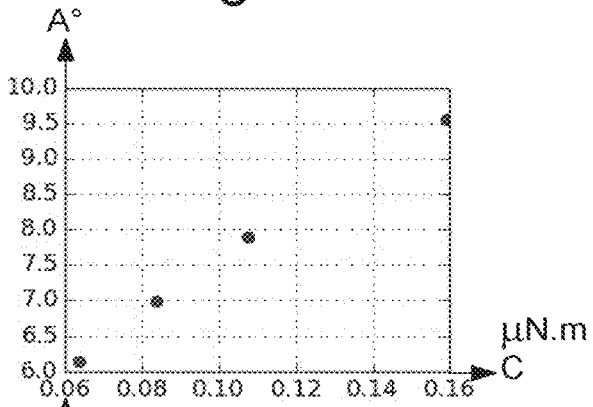
Fig. 14
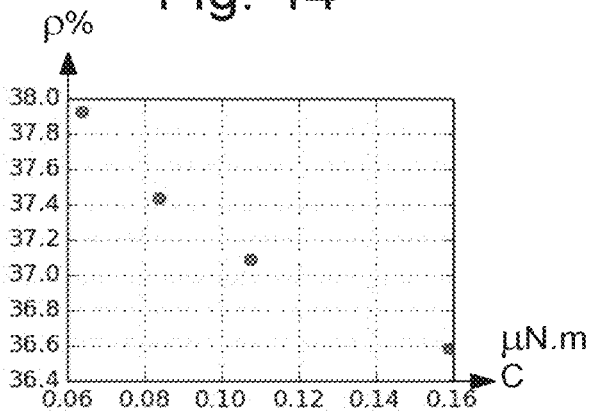
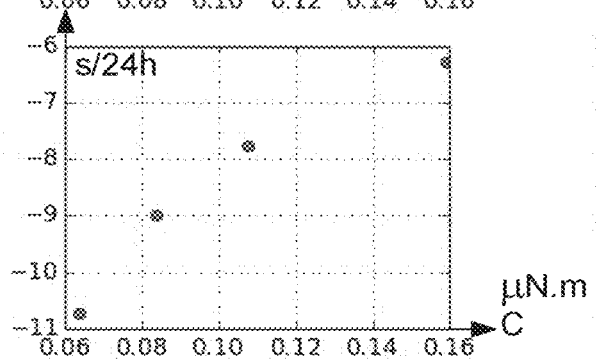
Fig. 13
Fig. 15
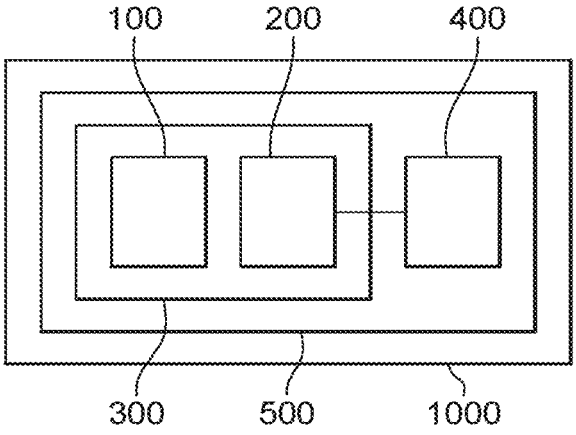

Fig. 16
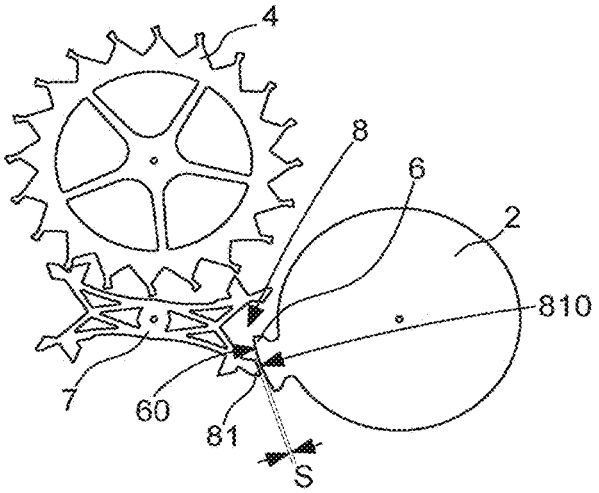
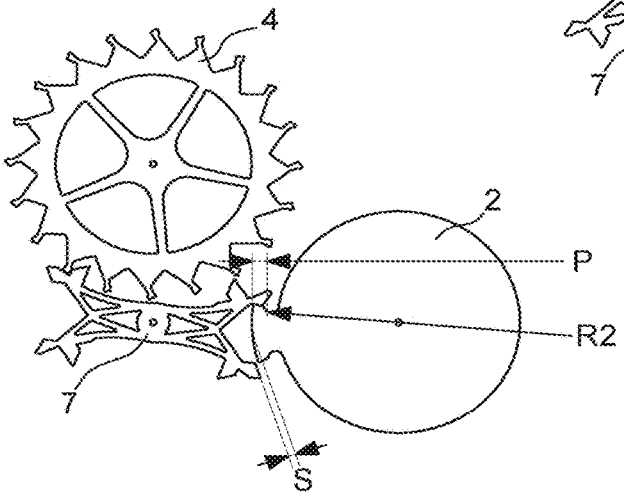
Fig. 17
Fig. 18
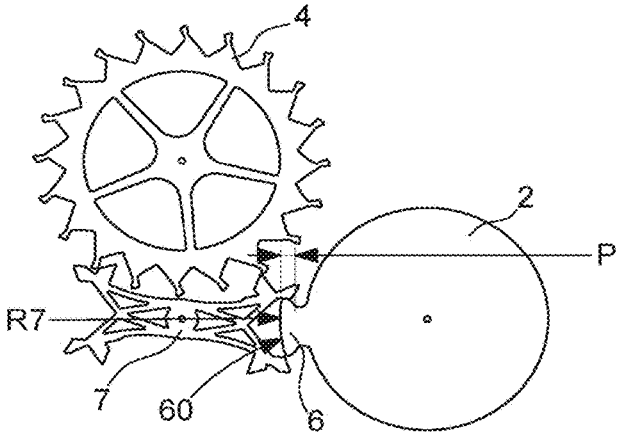
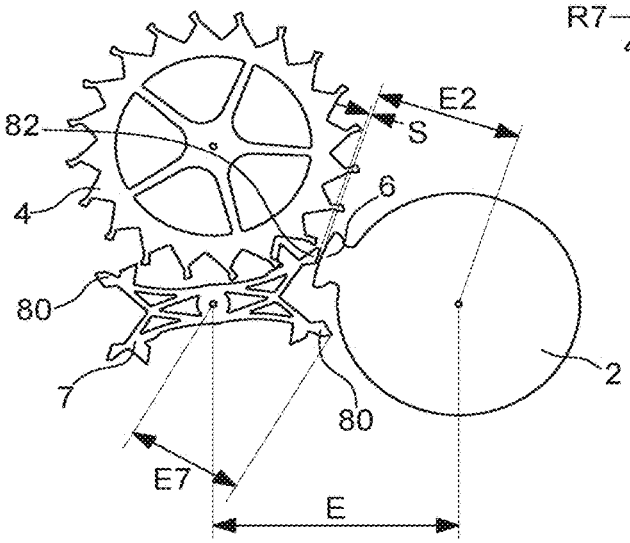
Fig. 19

ROTATING RESONATOR WITH FLEXURE BEARING MAINTAINED BY A DETACHED LEVER ESCAPEMENT

FIELD OF THE INVENTION

The invention concerns a timepiece regulating mechanism, comprising, arranged on a main plate, a resonator mechanism with a quality factor Q, and an escapement mechanism which is subjected to the torque of drive means comprised in a movement, said resonator mechanism comprising an inertial element arranged to oscillate with respect to said plate, said inertial element being subjected to the action of elastic return means directly or indirectly fixed to said plate, and said inertia element being arranged to cooperate with an escape wheel set comprised in said escapement mechanism.

The invention also concerns a timepiece movement comprising drive means, and such a regulating mechanism, whose escapement mechanism is subjected to the torque of these drive means.

The invention also concerns a watch, more particularly a mechanical watch, including such a movement, and/or such a regulating mechanism.

The invention concerns the field of timepiece regulating mechanisms, in particular for watches.

BACKGROUND OF THE INVENTION

Most mechanical watches include a balance/balance spring type oscillator, cooperating with a Swiss lever escapement. The balance/balance spring forms the time base of the watch. This is called the resonator here. The escapement performs two main functions, namely maintaining the back and forth motions of the resonator and counting these back and forth motions. The escapement must be robust, not disturb the balance far from its point of equilibrium, resist shocks, avoid jamming the movement (for example, in the event of overbanking), and thus forms a vital component of the timepiece movement.

Typically, a balance/balance spring oscillates with an amplitude of 300°, and the angle of lift is 50°. The angle of lift is the angle through which the balance travels as the lever fork interacts with the impulse pin, also called the roller-pin, of the balance. In most current Swiss lever escapements, the angle of lift is divided either side of the point of equilibrium of the balance (+/−25°), and the lever tilts by +/−7°.

The Swiss lever escapement belongs to the detached escapement category, since, beyond the half-angle of lift, the resonator no longer touches the lever. This characteristic is essential for obtaining good chronometric properties.

A mechanical resonator includes an inertia element, a guide member and an elastic return element. Conventionally, the balance forms the inertia element, and the balance spring forms the elastic return element. The balance is guided in rotation by pivots which rotate in smooth ruby bearings. The associated friction causes energy losses and disruptions of rate. It is sought to remove these disruptions, which, moreover, depend on the orientation of the watch in the field of gravity. Losses are characterized by the quality factor Q of the resonator. It is also generally to sought to maximise this quality factor Q, in order to obtain the best possible power reserve. It is clear that the guide member is an essential factor in losses.

The use of a rotary flexure bearing, instead of the pivots and conventional balance spring, is a solution that maximises the quality factor Q. Flexible strip resonators, provided they are well designed, have promising chronometric properties, independently of orientation in the field of gravity, and have high quality factors, particularly due to the absence of pivot friction. Further, the use of flexure bearings eliminates problems of wear of the pivots.

However, the flexible strips generally used in such rotary flexure bearings are stiffer than balance springs. This results in work at higher frequency, for example on the order of 20 Hz, and with a lower amplitude, for example 10° to 20°. This at first sight seems incompatible with a Swiss lever type escapement.

An operating amplitude compatible with a resonator with rotary flexure bearings, particularly with strips, is typically from 6° to 15°. This results in a certain angle of lift value, which must be twice the minimum operating amplitude.

In the absence of particular precautions, an escapement with a small angle of lift may have mediocre efficiency and cause too great a losing rate. However, the combination of a high frequency and a low amplitude makes possible speeds of motion of the balance which are acceptable, without being too high, and thus the efficiency of the escapement is not automatically mediocre.

The resonator must have acceptable dimensions, compatible with being housed inside a timepiece movement. It is not possible, to date, to make a rotary flexure bearing of very large diameter, or having several pairs of levels of strips, which, theoretically, by placing successive flexure bearings in series, would allow an oscillation amplitude of the inertia element of several tens of degrees: therefore a flexure bearing with one or two levels of strips at most should be used, for example as known from EP Patent No. 3035126 in the name of THE SWATCH GROUP RESEARCH AND DEVELOPMENT Ltd.

In short, the effect of choosing a rotary flexure bearing is that the amplitude of the balance is reduced, and it is no longer possible to use a conventional Swiss lever escapement, which requires a balance amplitude that is considerably higher than half the angle of lift, i.e higher than 25°. A regulator comprising a resonator with flexure bearings thus requires a particular escapement mechanism, of different dimensioning from that of a normal Swiss lever escapement devised to operate with the same inertia element of the resonator.

SUMMARY OF THE INVENTION

It is an overall object of the present invention to increase the power reserve and precision of current mechanical watches. To achieve this object, the invention combines a resonator having rotary flexure bearings with a lever escapement optimised to maintain acceptable dynamic losses and to limit the chronometric effect of the unlocking phase.

In the absence of teaching in the prior art as to the dimensioning of both the resonator and the escapement mechanism, analytical model calculations and a series of simulations have revealed parameters for the resonator and escapement that are compatible with an acceptable loss and acceptable efficiency.

These calculations and simulations demonstrate that the ratio between the inertia of the inertia element, particularly a balance, and the inertia of the pallet lever, is determinant.

To this end, the invention concerns a regulating mechanism according to claim 1.

These resonators with rotary flexure bearings have very high quality factors, for example on the order of 3000, compared to a quality factor of 200 for a normal watch. Dynamic losses (kinetic energy from the escape wheel and pallet lever at the end of the impulse) are independent of the quality factor. These losses may thus become too high with a high quality factor, in relative terms, in comparison to the energy transmitted to the balance.

For proper operation of the mechanism, an impulse pin integral with the inertia element must penetrate up to a certain value, referred to as 'depth', the opening in the lever fork. Likewise, to ensure safety during the unlocking phase, once the impulse pin is unlocked, it must then be able to be kept at a certain distance, called the safety distance, from the horn of the fork opposite to the horn with which it was in contact immediately prior to being unlocked.

Thus, the invention further endeavours to impose a particular relation between the dimensions of the lever fork, the depth and safety distance values, and the values of the angles of lift of the lever and of the inertia element, to ensure that the impulse pin is properly removed from the fork, once travel through the half-angle of lift is complete.

The invention also concerns a timepiece movement comprising drive means, and such a regulating mechanism, whose escapement mechanism is subjected to the torque of these drive means.

The invention also concerns a watch, more particularly a mechanical watch, including such a movement, and/or such a regulating mechanism.

BRIEF DESCRIPTION OF THE DRAWINGS

Other features and advantages of the invention will appear upon reading the following detailed description, with reference to the annexed drawings, in which:

FIGS. 12 to 14 are graphs comprising, on the abscissa, the torque applied to the escape wheel set, and on the ordinate, respectively the amplitude measured in degrees in FIG. 12, the loss in seconds per day in FIG. 13, and the efficiency of the regulator in % in FIG. 14.

FIG. 15 is a block diagram which represents a watch comprising a movement with drive means and a regulating mechanism according to the invention.

FIGS. 16 to 19 represent plan views of the kinematic stages, already symbolised by FIG. 6, as regards the impulse pin, the lever fork of FIG. 7, and the escape wheel set formed here by a conventional escape wheel:

FIG. 16: locking of the escape wheel on the entry pallet, supplementary arc of the resonator;

FIG. 17: unlocking;

FIG. 18: start of impulse;

FIG. 19: locking of the escape wheel on the exit pallet, supplementary arc of the resonator, and safety function.

DETAILED DESCRIPTION OF PREFERRED EMBODIMENTS

Figure 1:
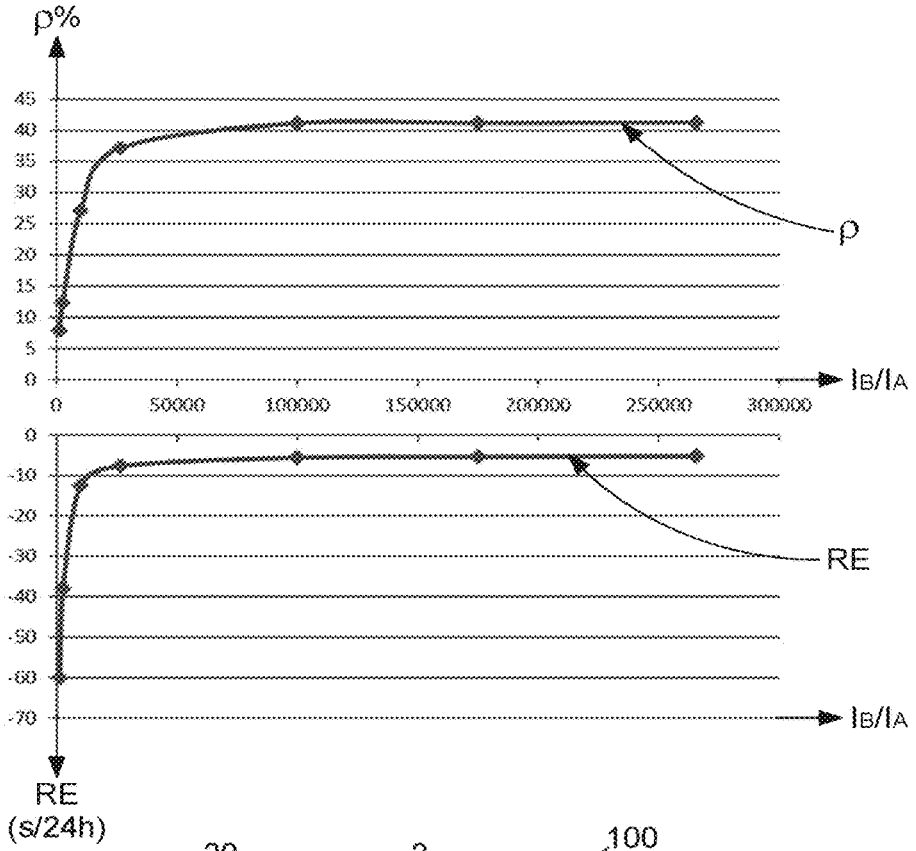
FIG. 1 includes a double graph including, on the same abscissa, the ratio between the inertia of the inertia element of the resonator and the inertia of the lever, and which shows, on the ordinate, for a particular example mechanism, on the one hand, in the positive portion in the top graph, the rate of efficiency of the regulator in %, and in the negative portion in the bottom graph, the losing rate in seconds per day; these top and bottom graphs are drawn for a same given escapement geometry, with specific values of the quality factor, angle of lift of the lever and operating amplitude.
Figure 2:
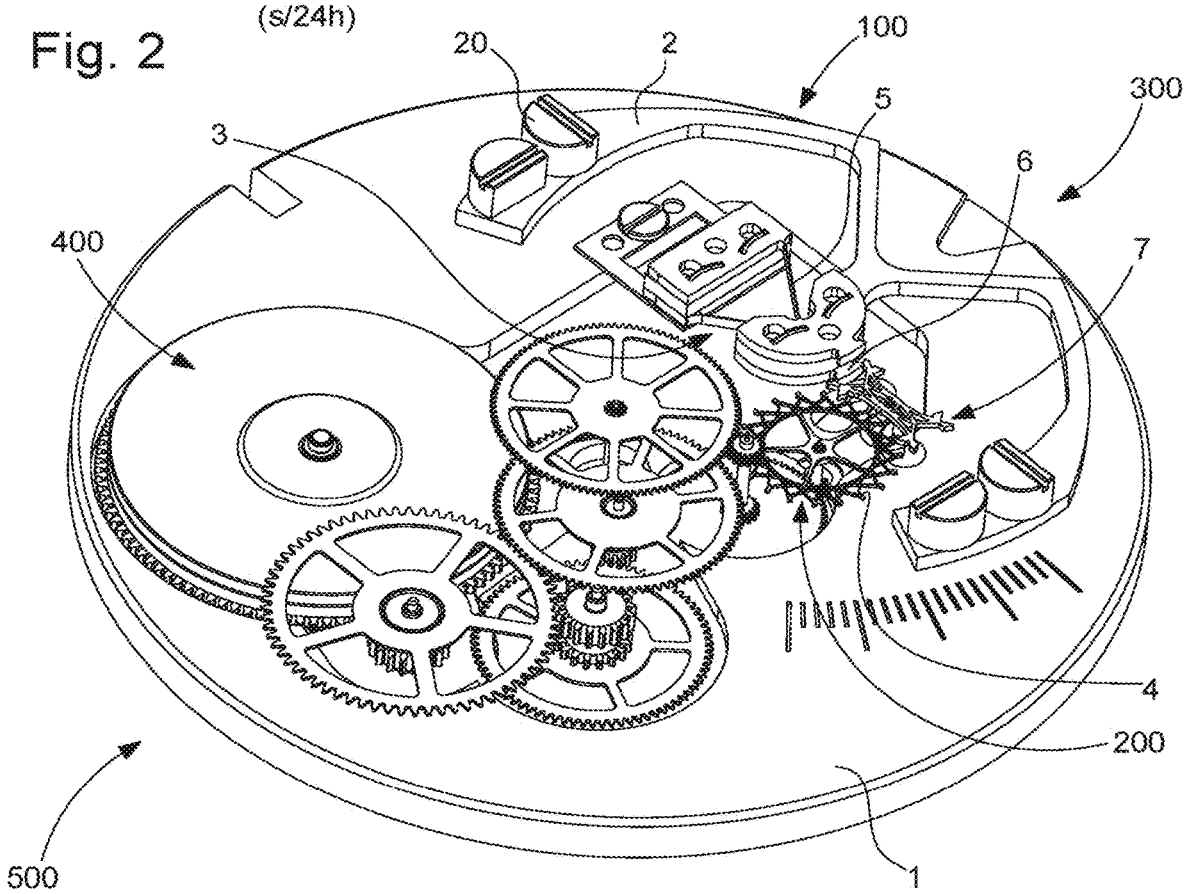
FIG. 2 represents a schematic, partial and perspective view of a timepiece movement, with a plate carrying a regulating mechanism according to the invention, comprising a resonator having flexure bearings with two flexible strips arranged on two parallel levels and crossed in projection, secured to the plate by means of an elastic element, this resonator including an extensive inertia element, shaped like the letter omega, and whose central portion, carried by the two flexible strips, carries an impulse pin arranged to cooperate with a symmetrical lever, (whose pivoting on the plate by means of a metal arbor is not represented), which in turn cooperates with a conventional escape wheel.
Figure 3:
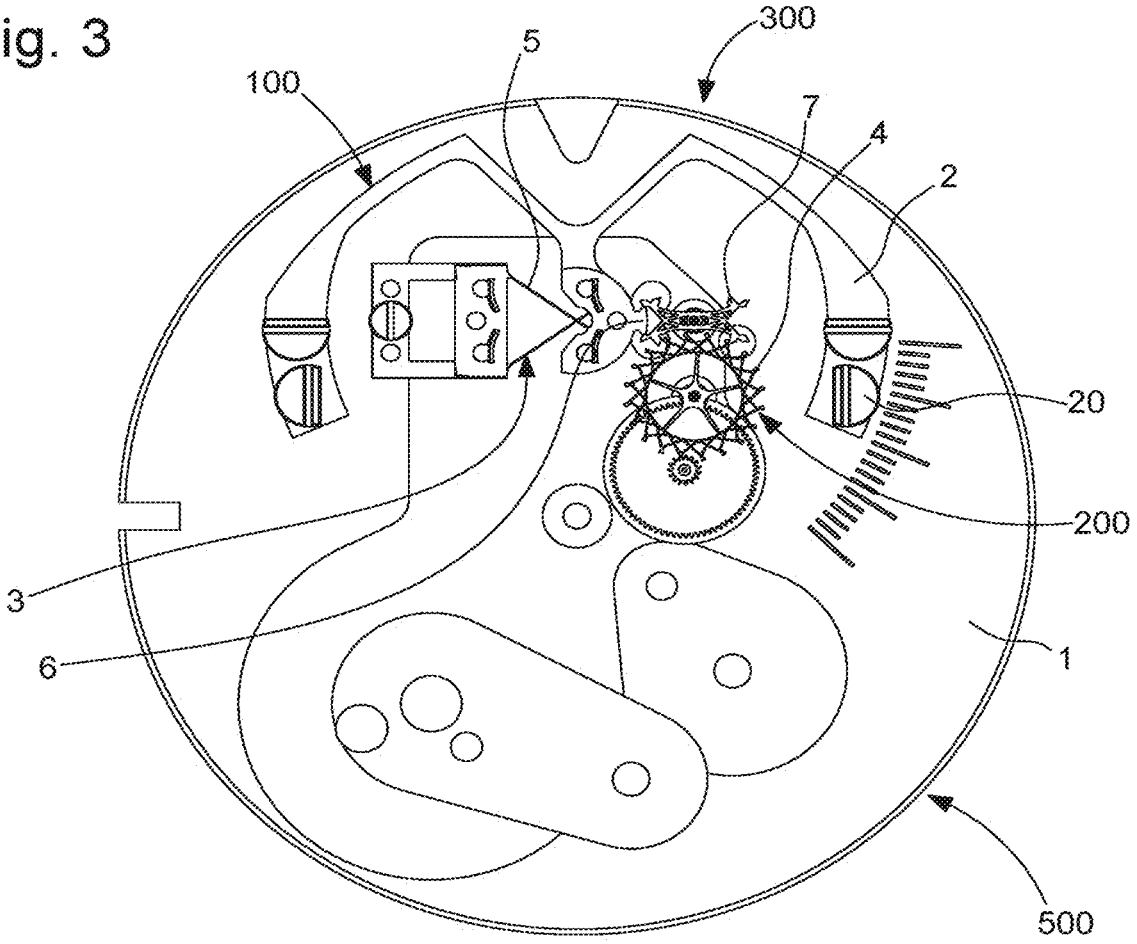
FIG. 3 represents a plan view of the regulating mechanism of FIG. 2, arranged on the plate of the movement.
Figure 4:
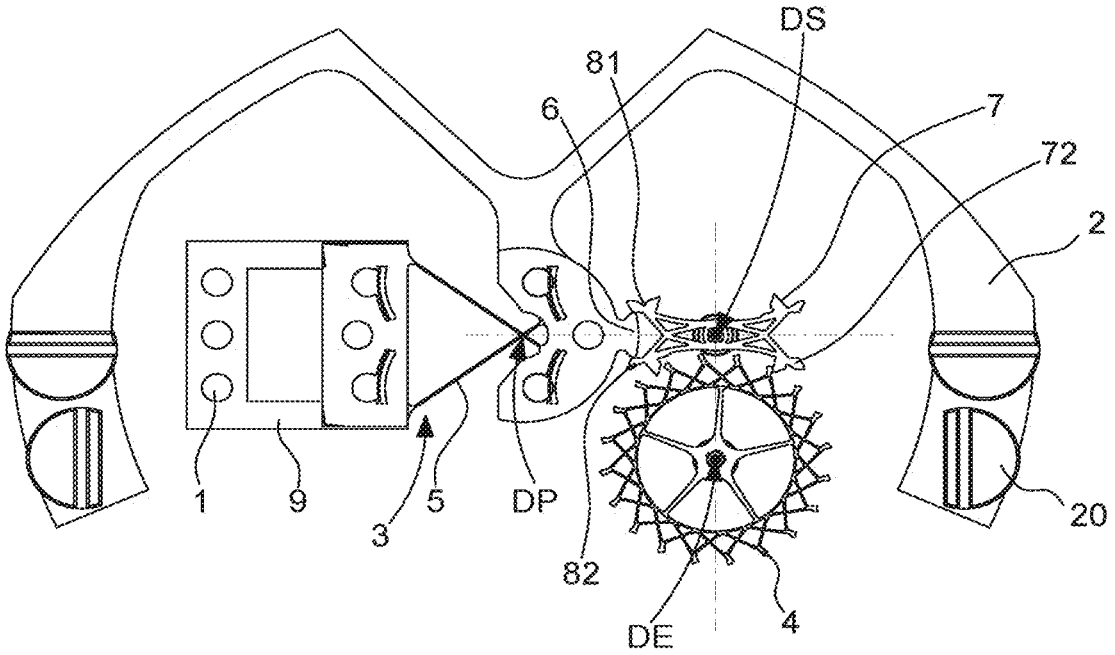
FIG. 4 represents a plan view of the detail of the regulating mechanism of FIG. 2.
Figure 5:
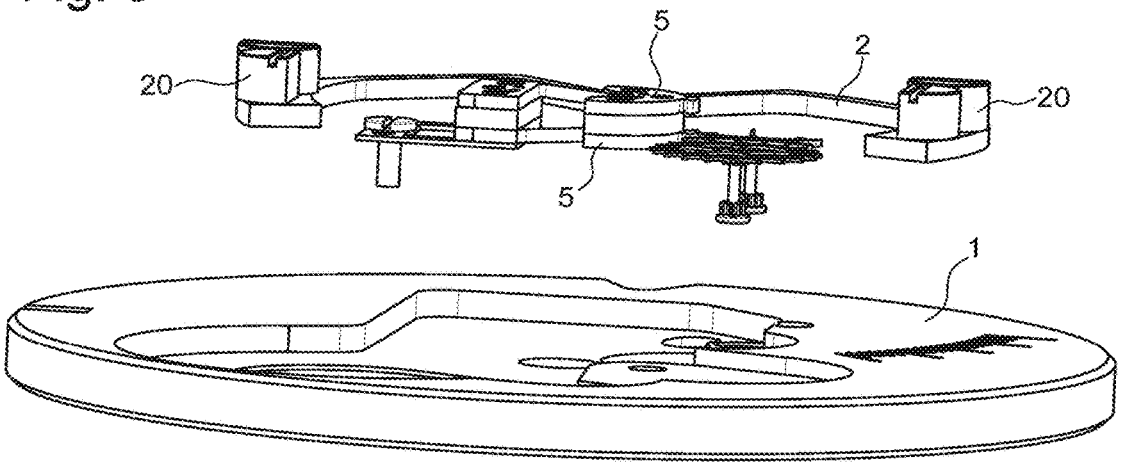
FIG. 5 represents a partially exploded perspective view of the regulating mechanism of FIG. 2.

The invention combines a resonator having a rotary flexure bearing, to increase the power reserve and precision, with an optimised lever escapement to maintain acceptable dynamic losses and to limit the chronometric effect of the unlocking phase.

The invention therefore concerns a timepiece regulating mechanism 300, comprising, arranged on a main plate 1, a resonator mechanism 100 with a quality factor Q and an escapement mechanism 200, which is subjected to the torque of drive means 400, comprised in a movement 500.

This resonator mechanism 100 includes an inertia element 2 which is arranged to oscillate with respect to plate 1. This inertia element 2 is subjected to the action of elastic return means 3 directly or indirectly secured to plate 1. Inertia element 2 is arranged to cooperate indirectly with an escape wheel set 4, particularly an escape wheel, which is comprised in escapement mechanism 200 and pivots about an escapement axis DE.

According to the invention, resonator mechanism 100 is a resonator with a virtual pivot rotating about a main axis DP, with a flexure bearing including at least two flexible strips 5, and includes an impulse pin 6 integral with inertia element 2. Escapement mechanism 200 includes a lever 7, which pivots about a secondary axis DS and includes a lever fork 8 arranged to cooperate with impulse pin 6, and is thus a detached escapement mechanism: during its operating cycle, resonator mechanism 100 has at least one phase of freedom in which impulse pin 6 is at a distance from lever fork 8. The lift angle β of the resonator, during which impulse pin 6 is in contact with lever fork 8, is less than 10°.

Taking a specific escapement geometry and a specific operating amplitude, in particular 8°, it is possible with dynamic multi-body simulations (i.e. relating to a set of several components, each of which is assigned a particular mass and inertia distribution) to evaluate the efficiency and loss of this escapement mechanism as a function of the inertia ratio between the inertia of the inertia element and the inertia of the lever, which cannot be established using normal kinematic simulations. As seen in FIG. 1, it is observed that, under the simulation conditions, there is a threshold of good efficiency, higher than 35%, and of low loss, less than 8 seconds per day, where the inertia of the inertia element, particularly of a balance, is 10000 times greater than the inertia of the lever.

The analytical model of the system thus showed that, if one wishes to limit dynamic losses, a particular condition links the inertia of the lever, the inertia of the inertia element, the resonator quality factor, and the angles of lift of the lever and of the inertia element: for a dynamic loss coefficient ε, the inertia $I_B$ of all the inertia elements 2 with respect to main axis DP, on the one hand, and the inertia $I_A$ of lever 7 with respect to secondary axis DS on the other hand, are such that the ratio $I_B/I_A$ is greater than $2Q\cdot\alpha^2/(0.1\cdot\pi\cdot\beta^2)$, where α is the lift angle of the lever which corresponds to the maximum angular travel of lever fork 8.

More particularly, if one wishes to limit dynamic losses to a factor ε=10%, the inertia $I_B$ of inertia element 2 with respect to main axis DP on the one hand, and the inertia $I_A$ of lever 7 with respect to secondary axis DS on the other hand, are such that the ratio $I_B/I_A$ is greater than $2Q\cdot\alpha^2/(0.1\cdot\pi\cdot\beta^2)$, where α is the lift angle of the lever which corresponds to the maximum angular travel of lever fork 8.

More particularly, the lift angle β of the resonator, which is an overall angle, taken from both sides of the rest position, is less than twice the angle of amplitude by which inertia element 2 deviates furthest, in only one direction of motion, from a rest position.

More particularly, the angle of amplitude by which inertia element 2 deviates furthest from a rest position, is comprised between 5° and 40°.

More particularly, during each vibration, in a contact phase, impulse pin 6 penetrates lever fork 8 with a depth of travel P greater than 100 micrometres, and in an unlocking phase, impulse pin 6 remains at a distance from lever fork 8 with a safety distance S greater than 25 micrometres.

Fork 8 of lever 7 is thus enlarged compared to a conventional Swiss lever fork, which is much narrower, allowing less freedom to pin 6, which would not be able to enter and exit the fork of a conventional Swiss lever with such a small angular amplitude. This concept of an enlarged fork allows a lever escapement to operate even when the resonator amplitude is much smaller than in a conventional balance spring, which is particularly advantageous for resonators with flexure bearings, which have a low amplitude, as in the current case. Indeed, it is important for the balance to be completely free at certain instants during the operating cycle.

Impulse pin 6 and lever fork 8 are advantageously dimensioned such that the width L of lever fork 8 is greater than $(P+S)/\sin(\alpha/2+\beta/2)$, depth of travel P and safety distance S being measured radially with respect to main axis DP.

Figure 6:
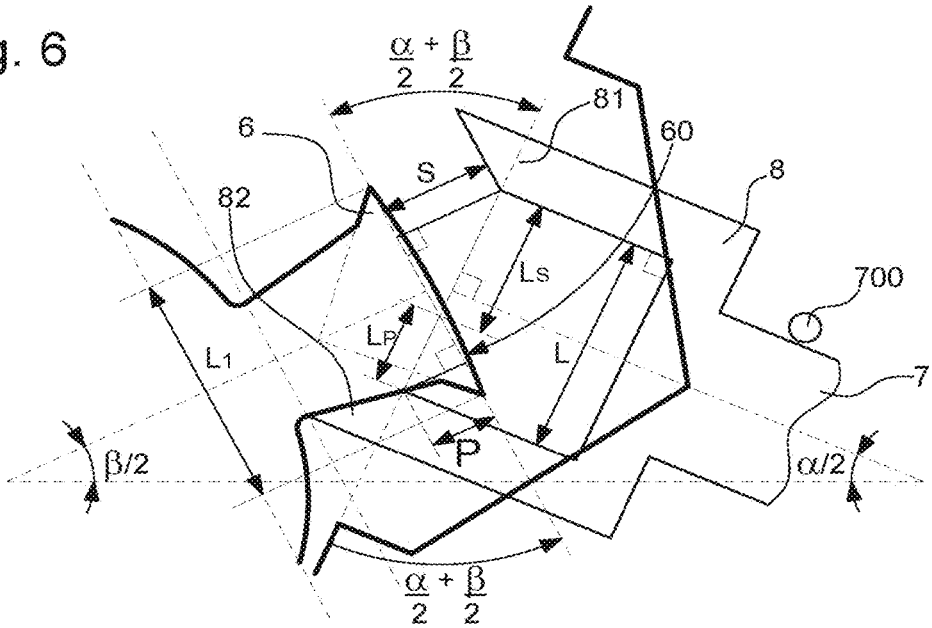
FIG. 6 represents a plan view of a detail of the area of cooperation between the impulse pin of the inertia element of the resonator, and the lever fork, represented in a stop position on a banking pin.

The useful width L1 of impulse pin 6, seen in FIG. 6, is slightly smaller than width L of lever fork 8, and, more particularly, less than or equal to 98% of L. Impulse pin 6 is advantageously tapered behind its useful width surface L1, the pin can, in particular, have a prismatic shape of triangular cross-section as suggested in the Figure, or similar.

Examination of the Figures reveals a complementary action on the positioning of pin 6, which is located much further from the axis of rotation of balance 2 than in a conventional escapement mechanism: the larger radius combined with a lower angle of pivoting makes it possible to maintain an equivalent curvilinear travel of pin 6, which is necessary for the pin to be able to perform its distribution/counting function. The use of a large-diameter balance is thus particularly advantageous.

More particularly, the eccentricity E2 of pin 6 with respect to the axis of the balance, and the eccentricity E7 of the horn of fork 8 with respect to the axis of lever 7, are comprised between 40% and 60% of the distance of centres E between the axis of lever 7 and the balance axis. More particularly, eccentricity E2 is comprised between 55% and 60% of distance of centres E, and eccentricity E7 is comprised between 40% and 45% of distance of centres E. More particularly, the area of interference between pin 6 and fork 8 extends over 5% to 10% of distance of centres E.

Thus, by design, the invention defines a new impulse pin/fork layout which has a very particular characteristic, wherein the horns of the fork are further apart, and the pin is wider than in a known type of Swiss lever mechanism with a normal angle of lift of 50°.

Thus, by substantially enlarging the lever fork in comparison to the usual proportions, it is also possible to design a Swiss lever escapement with a very small angle of lift, for example on the order of 10°.

FIG. 6 shows that, even with very low angles of pivoting, it is possible for pin 6 to enter fork 8 with a good depth of travel P, and exit therefrom with a sufficient safety distance S.

FIGS. 16 to 19 illustrate the kinematics and show that suitable depths of travel P and safety distances S are obtained by this combined design, wherein pin 6 is very far away from the balance axis and lever 7 has a particular shape, especially with an enlarged fork.

The advantage, for maximising the efficiency of the resonator, of the particular relation set out above, which links the inertia of the inertia element and the inertia of the lever in a ratio of more than 10,000, is evident.

It is therefore particularly advantageous to have a lever which is both very small and very light, and a balance of large dimensions and high mass.

More particularly, lever 7 is made of silicon, which allows for a miniaturised and very precise embodiment, with a density of less than one third of that of steel. The fact that the lever is made of silicon decreases its inertia compared to a metal lever. Low inertia of the lever compared to the balance is crucial in order to obtain good efficiency with a low amplitude and high frequency, in the present case of resonators with flexure bearings.

When permitted by the range of the watch, the balance is advantageously made of a heavy metal or alloy, containing gold, platinum, tungsten, or similar, and may include inertia blocks of similar composition. Otherwise, the balance is made in a conventional manner from a copper-beryllium alloy CuBe2 or similar, and ballasted with poising inertia blocks and/or adjustment inertia blocks made of nickel silver or another alloy.

More particularly, this lever 7 is on a single level of silicon, placed on an arbor made of metal or similar, such as ceramic or otherwise, pivoted with respect to plate 1.

More particularly, escape wheel set 4 is a silicon escape wheel.

More particularly, escape wheel set 4 is an escape wheel that is perforated to minimise its inertia with respect to its axis of pivoting DE.

More particularly, lever 7 is perforated to minimise its inertia $I_A$ with respect to secondary axis DS.

Preferably, lever 7 is symmetrical with respect to secondary axis DS, in order to avoid any unbalance, and to avoid unwanted torque in the event of linear impact, particularly in translation. An additional advantage is thus the great ease of assembly of this very small component, which can be handled by the operator performing the assembly from any side.

Figure 7:
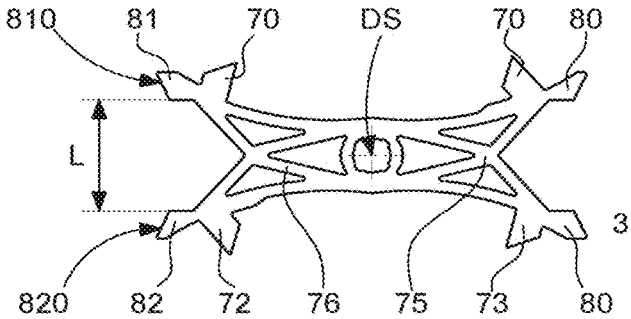
FIG. 7 represents a plan view of the lever of the mechanism of FIG. 2, shaped like the horns of Watusi cattle.
Figure 8:
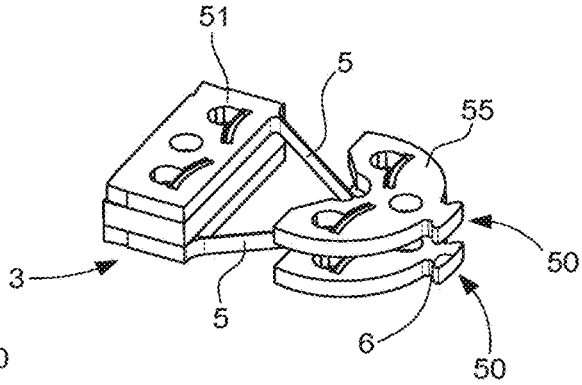
FIG. 8 represents a plan view of the flexure bearing of the mechanism of FIG. 2.
Figure 9:
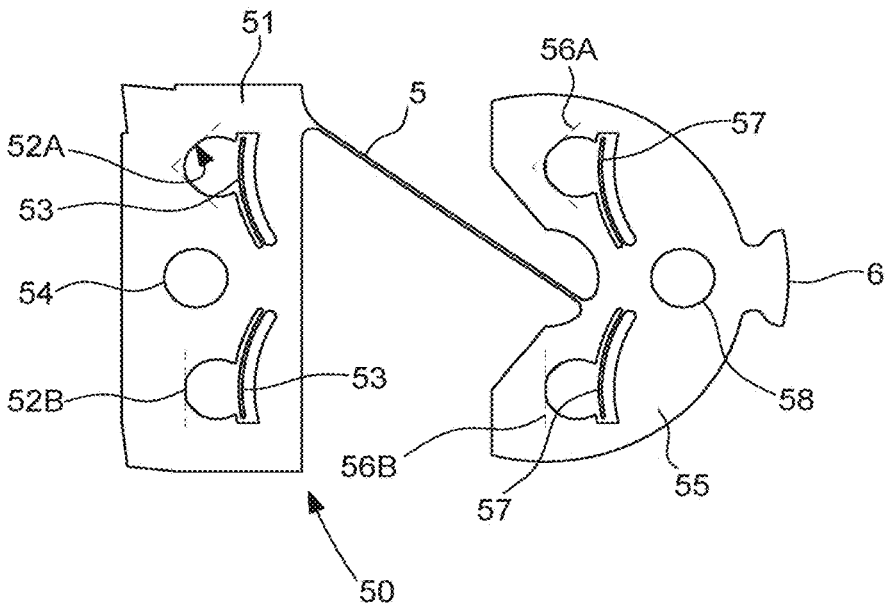
FIG. 9 represents a plan view of a particular embodiment of one level of the flexure bearing of the mechanism of FIG. 2.

FIG. 7 shows the two horns 81 and 82 arranged to cooperate with impulse pin 6, pallets 72 and 73 arranged to cooperate with teeth of escape wheel set 4, and horn-like elements 80 and pallet-like elements 70 whose only role is to achieve perfect balancing.

More particularly, the largest dimension of inertia element 2 is greater than half the largest dimension of plate 1.

More particularly, main axis DP, secondary axis DS and the axis of pivoting of escape wheel set 4 are arranged to be centred at a right angle, whose apex is on secondary axis DS. It is thus clear that, compared to a conventional T-shaped Swiss lever with a lever shaft and two arms, the shaft is removed and becomes one of the two arms 76, seen in FIG. 7, which carries horns 81 and 82 and exit pallet 72 almost coincident with horn 82, the other arm 75 carrying entry pallet 73.

The comparison with the Swiss lever can be continued as regards the means for preventing overbanking, usually formed by a guard pin located on an offset plane of the lever. This function is important for preventing any jamming of the balance. In particular, the balance has no safety roller and thus no roller notch arranged to cooperate with such a guard pin. Here, because of the small angles of pivoting, the impulse pin is never far from the fork. The overbanking prevention function is thus advantageously performed by the combination of edge 60, in the form of an arc of a circle, of impulse pin 6, and by the corresponding surface 810, 820, of the horn 81, 82 concerned: this horn plays the usual part of a guard pin, and the periphery of the impulse pin plays the part of the safety roller. The additional resulting advantage is that, where it cooperates with the single-level lever, the balance can also be on one level, which simplifies its fabrication and reduces its cost.

The design of a single-level lever, which greatly simplifies fabrication of the lever, is possible only because overbanking is thus prevented by the low amplitude of the resonator, combined with the large width of the impulse pin (pin width is approximately equal to the enlarged fork).

More particularly, the flexure bearing includes two flexible strips 5 which are crossed in projection onto a plane perpendicular to main axis DP, at a virtual pivot defining main axis DP, and located on two parallel and distinct levels. More particularly still, the two flexible strips 5, in projection onto a plane perpendicular to main axis DP, form therebetween an angle comprised between 59.5° and 69.5°, and intersect at between 10.75% and 14.75% of their length, such that resonator mechanism 100 has a deliberate isochronism error which is the additive inverse of the loss error at the escapement of escapement mechanism 200.

The resonator thus has an anisochronism curve which compensates for the loss caused by the escapement. This means that the detached resonator is designed with an isochronism error which is the additive inverse of the error caused by the lever escapement. The design of the resonator therefore compensates for the loss at the escapement.

Figure 10:
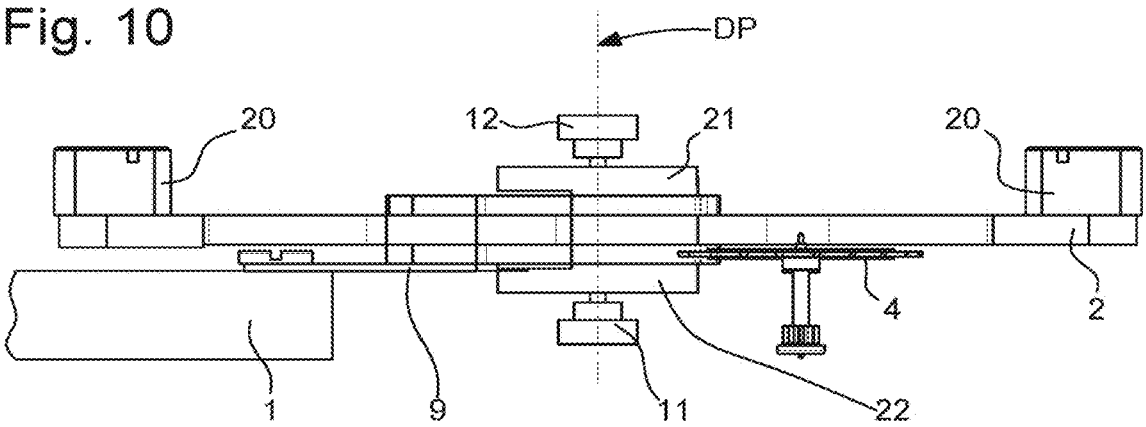
FIG. 10 represents a side view of the regulating mechanism of FIG. 2.

More particularly, the two flexible strips 5 are identical and are positioned in symmetry. More particularly still, each flexible strip 5 forms part of a one-piece assembly 50, in one piece with two solid parts 51, 55, and with its first means of alignment 52A, 52B, and of attachment 54 to plate 1, or, advantageously and as seen in FIG. 10, of attachment to an intermediate elastic suspension strip 9 attached to plate 1, and which is arranged to allow a displacement of the flexure bearing and of inertia element 2 in the direction of main axis DP, so as to ensure good protection against shocks in direction Z perpendicular to the plane of such a one-piece assembly 50, and thus prevent breakage of the flexure bearing strips. This intermediate elastic suspension strip 9 is advantageously made of a "Durimphy" alloy or similar. In the non-limiting variant illustrated in the Figures, the first alignment means are a first V-shaped portion 52A and a first flat portion 52B, and the first attachment means include at least a first bore 54. A first press strip 53 presses on the first attachment means. Likewise, one-piece assembly 50 includes, for attachment thereof to inertia element 2, second alignment means which are a second V-shaped portion 56A and a second flat portion 56B and the second attachment means include at least a second bore 58. A second press strip 57 presses on the second attachment means.

Flexure bearing 3 with crossed strips 5 is advantageously formed of two identical, silicon, one-piece assemblies 50, assembled in symmetry to form the crossing of the strips, and aligned precisely with respect to each other by means of the integrated alignment means and auxiliary means, such as pins and screws, which are not represented in the Figures.

Thus, more particularly, at least resonator mechanism 100 is attached to an intermediate elastic suspension strip 9 attached to plate 1 and arranged to allow a displacement of resonator mechanism 100 in the direction of main axis DP, and plate 1 includes at least one shock absorber stop 11, 12, at least in the direction of main axis DP, and preferably at least two such shock absorber stops 11, 12, which are arranged to cooperate with at least one stiff element of inertia element 2, for example a flange 21 or 22 added during assembly of the inertia element to flexure bearing 3 comprising strips 5.

The elastic suspension strip 9, or a similar device, allows displacements of the entire resonator 100 substantially in the direction defined by virtual axis of rotation DP of the bearing. The object of this device is to avoid strips 5 breaking in the event of transverse impact in direction DP.

Figure 11:
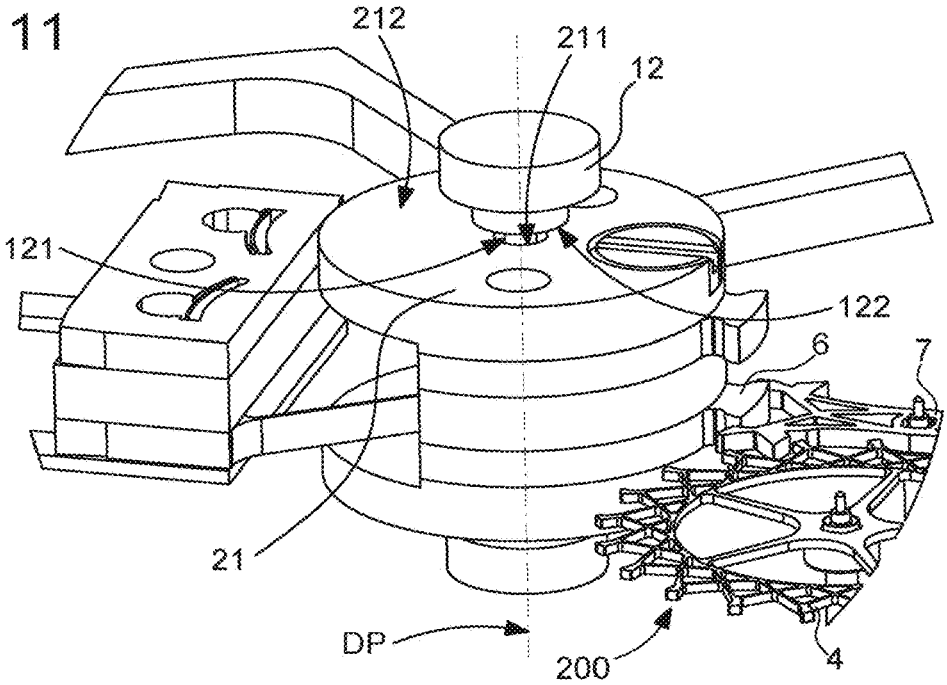
FIG. 11 represents, in perspective, a detail of the regulating mechanism of FIG. 2, showing the shock absorber stops on its plate.

FIG. 11 illustrates the presence of shock absorber stops limiting the travel of inertia element 2 in three directions in case of impact but located at a sufficient distance for the inertia element not to touch the stops under the effect of gravity. For example, flange 21 or 22 includes a bore 211 and a face 212, able to cooperate respectively in a shock absorber stop arrangement with a trunnion 121 and a complementary surface 122 on stop 21 or 22.

More particularly, inertia element 2 includes inertia blocks 20 for adjusting rate and unbalance.

More particularly, impulse pin 6 is in one-piece with a flexible strip 5, or more particularly, a one-piece assembly 50 as illustrated in the Figures.

More particularly, lever 7 includes bearing surfaces arranged to cooperate in abutment with teeth comprised in escape wheel set 4 and to limit the angular travel of lever 7. These bearing surfaces limit the angular travel of the lever, as solid banking would do. The angular travel of lever 78 can also be limited in a conventional manner by banking pins 700.

More particularly, flexure bearing 3 is made of oxidised silicon to compensate for the effects of temperature on the rate of regulating mechanism 300.

The invention also concerns a timepiece movement 500 comprising drive means 400, and such a regulating mechanism 300, whose escapement mechanism 200 is subjected to the torque of these drive means 400.

The graphs of FIGS. 12 to 14 set out a series of results from simulations in which Q=2000, $I_B$=26550 mg·mm$^2$, the frequency is 20 Hz, the escape wheel set has 20 teeth, more particularly the lift angle $\alpha$ of the lever is 14°, and the lift angle $\beta$ of the resonator is 10°.

The invention also concerns a watch 1000, more particularly a mechanical watch, including such a movement 500, and/or such a regulating mechanism 300.

In short, the present invention makes it possible to increase the power reserve and precision of current mechanical watches. For a given movement size, the autonomy of the watch can be quadrupled, and the regulating power of the watch can be doubled. This means that the invention provides a gain of a factor 8 in the performance of the movement.

The invention claimed is:

1. A timepiece regulating mechanism, comprising:

a resonator mechanism arranged on a main plate, the resonator mechanism having an energy loss quality factor Q; and an escapement mechanism arranged on the main plate, the escapement mechanism being subjected to the torque of drive means comprised in a movement, wherein said resonator mechanism includes an inertia element arranged to oscillate with respect to said plate, said inertia element being subjected to the action of elastic return means directly or indirectly attached to said plate, and said inertia element being arranged to cooperate indirectly with an escape wheel set comprised in said escapement mechanism, wherein said resonator mechanism is a resonator with a virtual pivot rotating about a main axis, with a flexure bearing including at least two flexible strips, and including an impulse pin integral with said inertia element, wherein said escapement mechanism includes a lever pivoting about a secondary axis and including a lever fork arranged to cooperate with said impulse pin, and is a detached escapement mechanism, wherein, during an operating cycle, said resonator mechanism has at least one phase of freedom in which said impulse pin is at a distance from said lever fork, wherein at least said resonator mechanism is attached to an intermediate, elastic suspension strip attached to said plate and arranged to allow a displacement of said resonator mechanism in a direction of said main axis, and in that said plate includes at least one shock absorber stop at least in the direction of said main axis, arranged to cooperate with at least one stiff element of said inertia element, wherein a lift angle $\beta$ of the resonator, during which said impulse pin is in contact with said lever fork, is less than 10°, and wherein said main axis, said secondary axis and the axis of pivoting of said escape wheel set, are arranged to be centered at a right angle whose apex is on said secondary axis within a plane defined perpendicular to the main axis, secondary axis, and axis of pivoting.

2. The timepiece regulating mechanism according to claim 1, wherein the inertia IB of said inertia element with respect to said main axis on the one hand, and the inertia IA of said lever with respect to said secondary axis on the other hand, are such that the ratio IB/IA is greater than $2Q\cdot\alpha^2/(0.1\cdot\pi\cdot\beta^2)$, where $\alpha$ is a lift angle of the lever which corresponds to the maximum angular travel of said lever fork.

3. The timepiece regulating mechanism according to claim 1, wherein an overall lift angle of the resonator is less than twice the angle of amplitude by which said inertia element deviates furthest, in only one direction of motion, from a rest position.

4. The timepiece regulating mechanism according to claim 1, wherein the angle of amplitude, by which said inertia element deviates furthest from a rest position, is comprised between 5° and 40°.

5. The timepiece regulating mechanism according to claim 1, wherein, during each vibration, in a contact phase, said impulse pin penetrates said lever fork with a depth of travel greater than 100 micrometers, and in an unlocking phase, said impulse pin remains at a distance from said lever fork with a safety distance greater than 25 micrometers, and in that said impulse pin and said lever fork are dimensioned such that the width of said lever fork is greater than $(P+S)/\sin(\alpha/2+\beta/2)$, said depth of travel and said safety distance being measured radially with respect to said main axis where $\alpha$ is a lift angle of the lever which corresponds to the maximum angular travel of said lever fork, P is a depth of travel of the impulse pin with respect to the lever fork, and S is a distance between the impulse pin and the lever fork during the unlocking phase.

6. The timepiece regulating mechanism according to claim 1, wherein said lever is in a single layer of silicon, placed on an arbor pivoted with respect to said plate.

7. The timepiece regulating mechanism according to claim 1, wherein said escape wheel set is a silicon escape wheel.

8. The timepiece regulating mechanism according to claim 1, wherein said escape wheel set is an escape wheel which is perforated to minimize its inertia with respect to its axis of pivoting.

9. The timepiece regulating mechanism according to claim 1, wherein said lever is perforated to minimize its said inertia with respect to said secondary axis.

10. The timepiece regulating mechanism according to claim 1, wherein said lever is symmetrical with respect to said secondary axis.

11. The timepiece regulating mechanism according to claim 1, wherein the largest dimension of said inertia element is greater than half the largest dimension of said plate.

12. The timepiece regulating mechanism according to claim 1, wherein said flexure bearing includes two flexible strips which are crossed in projection onto a plane perpendicular to said main axis, at said virtual pivot defining said main axis, and located in two parallel and distinct levels.

13. The timepiece regulating mechanism according to claim 12, wherein said two flexible strips, in projection onto a plane perpendicular to said main axis, form therebetween an angle comprised between 59.5° and 69.5°, and intersect at between 10.75% and 14.75% of their length, such that said resonator mechanism has a deliberate isochronism error which is the additive inverse of the loss error at the escapement of said escapement mechanism.

14. The timepiece regulating mechanism according to claim 12, wherein said two flexible strips are identical and are positioned in symmetry.

15. The timepiece regulating mechanism according to claim 12, wherein each said flexible strip forms part of a one-piece assembly in one piece with means thereof for alignment and attachment to said plate or to said intermediate elastic suspension strip.

16. The timepiece regulating mechanism according to claim 1, wherein said inertia element includes inertia blocks for adjusting rate and unbalance.

17. The timepiece regulating mechanism according to claim 1, wherein said impulse pin is in one-piece with a said flexible strip.

18. The timepiece regulating mechanism according to claim 1, wherein said lever includes bearing surfaces arranged to cooperate in abutment with teeth comprised in said escape wheel set and to limit the angular travel of said lever.

19. The timepiece regulating mechanism according to claim 1, wherein said flexure bearing is made of oxidized silicon to compensate for the effects of temperature on the rate of said regulating mechanism.

20. A timepiece movement including drive means and a regulating mechanism according to claim 1, wherein said escapement mechanism is subjected to the torque of said drive means.

21. A watch including a timepiece movement according to claim 20.

22. A watch including a regulating mechanism according to claim 1.

* * * * *